United States Patent [19]

Griffiths

[11] 4,172,589

[45] Oct. 30, 1979

[54] CUSHION SUPPORT ELEMENT

[75] Inventor: David T. Griffiths, Pontardulais, Wales

[73] Assignee: Youngflex S.A., Fribourg, Switzerland

[21] Appl. No.: 877,186

[22] Filed: Feb. 13, 1978

[30] Foreign Application Priority Data

Feb. 28, 1977 [GB] United Kingdom ..... 8410/77

[51] Int. Cl.[2] ..... A47C 23/145

[52] U.S. Cl. ..... 267/110; 5/448

[58] Field of Search ..... 267/110, 111, 112, 142, 267/143, 182; 5/354; 403/207, 209, 213, 347; 256/6, 7, 45, 47, 48, 58

[56] References Cited

U.S. PATENT DOCUMENTS

| | | | |
|---|---|---|---|
| 486,463 | 11/1892 | Green | 256/45 |
| 784,564 | 3/1905 | Horsley | 256/45 |
| 3,539,172 | 11/1970 | Arnold et al. | 267/112 |
| 3,667,749 | 6/1972 | Platt et al. | 267/112 |
| 3,865,675 | 2/1975 | Arnold | 5/354 |

FOREIGN PATENT DOCUMENTS

| | | | |
|---|---|---|---|
| 1052920 | 1/1954 | France | 267/110 |
| 1193065 | 5/1920 | United Kingdom . | |

*Primary Examiner*—Edward R. Kazenske

*Attorney, Agent, or Firm*—Berman, Aisenberg & Platt

[57] ABSTRACT

In a cushion support element for incorporation in a structure such as a seat, bed or the like comprising a platform formed by lateral side edge wires sheathed in a compressible material, and a plurality of transverse spring wires wound around the sheathing of the edge wires, an improved connection is provided between the transverse wires and the edge wires in that the transverse wires are wound around the sheathing, hooked over upon themselves to provide an interlocked connection and then bent back towards the sheathing so that their free ends engage the latter. This both shields the sharp ends of the transverse wires and also urges the sheathing into the crook of the wound transverse wire to ensure a tighter connection.

3 Claims, 7 Drawing Figures

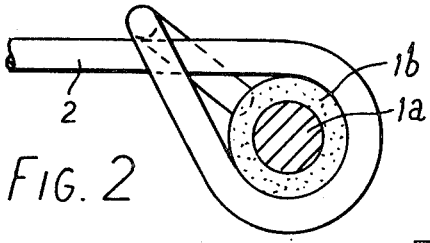
FIG. 2
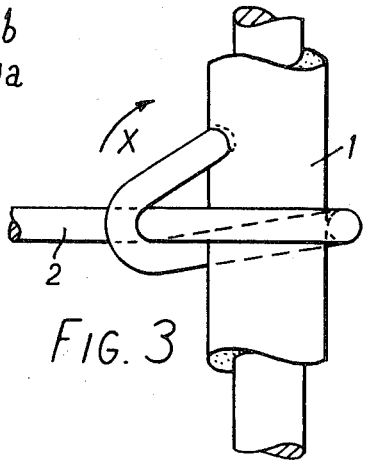
FIG. 3
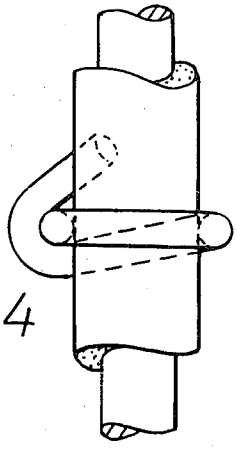
FIG. 4
FIG. 5
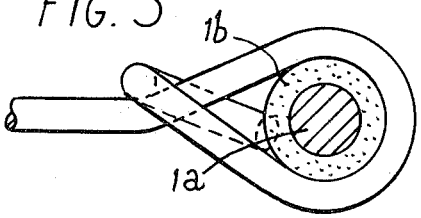
FIG. 6
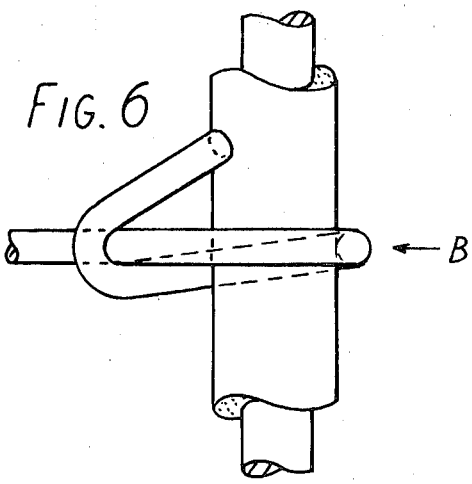
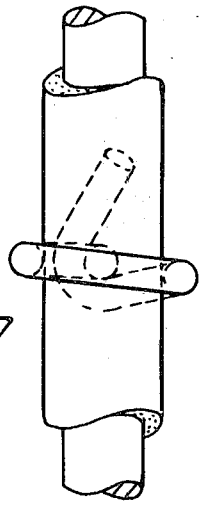
FIG. 7

CUSHION SUPPORT ELEMENT

BACKGROUND OF THE INVENTION

This invention relates to a cushion support element for incorporation in a structure such as a seat, more especially a vehicle seat, a bed, or the like.

In the construction of seats, a particularly simple and effective form of sprung cushioning is provided by a cushion supporting platform suspended from the seat frame by means of formed wire tension springs and over which is supported a layer of synthetic plastics foam cushioning material, for example polyurethane foam. The supporting platform should be at least partly flexible, and previous proposals for the construction of such a platform include rubber diaphragms and wire lattice or metal mesh constructions.

One such construction of platform element that has proved successful is that described in U.S. Pat. No. 3,367,648. This comprises two paper wrapped side edge wires between which extend a plurality of transverse parallel wires formed of tempered spring wire such as piano wire. The transverse wires are wound around the edge wires and by deformation of the paper wrapping become interlocked therewith to maintain their relative spacing. In addition, the element may include one or more longitudinal twisted paper cords extending parallel to the side edge wires, the transverse wires penetrating the paper cord and thus being located thereby.

The above construction has the advantages of simplicity and relative cheapness, and is also very convenient to suspend in a seat frame, since formed wire tension springs may simply be anchored at one end to the seat frame and hooked at the other over the side edge wires, as described in British Patent Specification No. 1,193,065.

In such a construction of platform element, the ends of the transverse wires are wound around the side edge wires and are then bent approximately at right angles to hook over upon themselves. This arrangement, owing to the self-interlocking effect provided by the hooked ends of the transverse wires positively prevents unwinding of the wire ends under the load placed upon the seat and has proved very effective in current use. However, a drawback of the construction is the difficulty of forming the spring wire of which the transverse wires are made in such a manner as to ensure a tight connection at the side edge wires. Tempered spring wire is difficult to deform by mass-production techniques and it is not therefore possible to employ the conventional wire knots applicable to more malleable wire such as is used for example in wire netting or fencing wire. For this reason, at their point of engagement with the side edge wires, the transverse wires do not fully encircle the paper wrapped side edge wires and there is a loose connection which allows relative angular movement of the side edge wires and the transverse wires and gives the impression of a poor quality product. Moreover the projecting end of the wire hook presents a snag upon which the hands of an operative assembling a seat structure may be caught and injured, or upon which a suspension spring may unintentionally become hooked. The projecting end also tends to abrade against adjacent cushioning material of the seat, when in use, which in some circumstances may lead to unacceptable deterioration of the seat.

SUMMARY OF THE INVENTION

It is accordingly an object of the present invention to provide an improved cushion support element comprising two, opposed lateral, side edge wires sheathed in a compressible material and a plurality of parallel transverse wires of tempered spring wire wound around the compressible sheathing of said side edge wires and then hooked over to interlock with themselves wherein a firmer connection is provided between said transverse and said side edge wires.

In accordance with the invention, this object is achieved by the improvement wherein the hooked ends of said transverse wires are of substantially U-shaped configuration whereby one limb of the U forms a continuation of the winding embracing said sheathing and the other extends back into contact with said sheathing. Such a construction has the added advantage that the ends of said transverse wires do not project from the plane of the platform and thus do not constitute a hazard.

Preferably the free ends of said transverse wires are firmly embedded in said sheathing.

If desired the transverse wires may be located intermediate their ends by penetrating longitudinal cords arranged between said side edge wires.

Said side edge wires may, if desired, form part of a continuous edge frame forming a periphery of the cushion support element.

BRIEF DESCRIPTION OF THE DRAWINGS

FIG. 2 is a section on the line II—II of FIG. 1, showing a detail of the element in accordance with the invention, FIG. 3 is a plan view of the detail shown in FIG. 2, FIG. 4 is a side view of a detail similar to that shown in FIG. 3, taken from the edge of the element shown in FIG. 1, in the direction of the arrow A, and FIGS. 5–7 are views similar to FIGS. 2–4, showing a further embodiment of the invention.

DETAILED DESCRIPTION OF THE PREFERRED EMBODIMENTS

Figure 1:
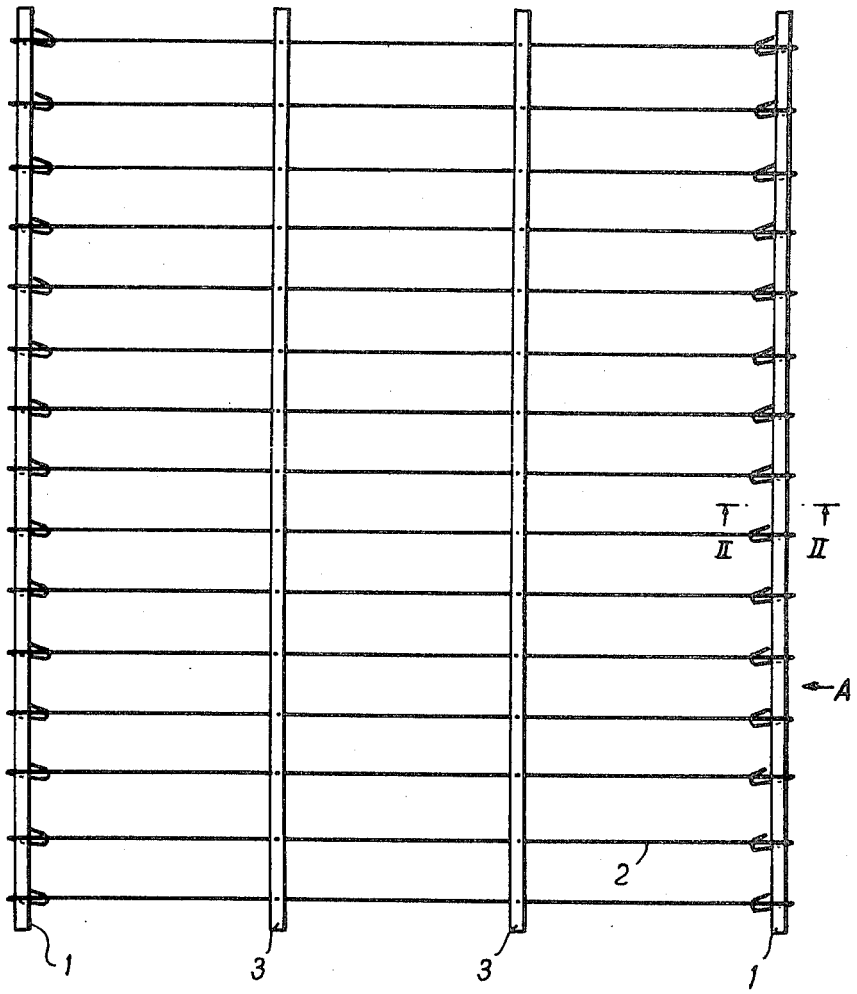
FIG. 1 is a plan view of a seat support element in accordance with the invention.

Referring to the drawings, a cushion supporting element in accordance with the invention comprises a pair of side edge wires 1 which, as shown in FIG. 2, comprise a central wire core 1*a* of relatively heavy gauge piano wire provided with an outer sheathing 1*b* of soft compressible material such as a paper wrapping or a sheathing of synthetic plastics material. Between the two side edge wires 1 extend a plurality of parallel transverse wires 2, also formed of tempered spring wire such as piano wire, of substantially lighter gauge than the wire cores 1*a*. Between the edge wires 1 are provided a pair of longitudinally extending cords 3, which may consist of twisted paper or synthetic plastics material. The transverse wires 2 penetrate the cords 3, and thus become located thereby at points intermediate the edge wires 1.

As shown in more detail in FIGS. 2 to 4, each of the transverse wires 2 is connected at its ends to the side edge wires 1 by being wound about the sheathing 1*b* and then extends substantially tangentially from the outer sheathing into engagement with itself, at which point it is hooked over in a substantially U shape, with its free end returning into contact with the sheathing 1*b* and being slightly embedded therein as shown.

Owing to the fact that the free end of the wire 2 is bent at a relatively narrow acute angle into a U shape, it can be seen, more especially from FIG. 2, that the edge wire 1 is pressed firmly into engagement with the loop of wire encircling it, so that the tendency of the edge wire 1 to move loosely within the encircling loop of wire is reduced, and a firmer joint is achieved. For example, angular movement of the transverse wires 2 in the direction of the arrow X in FIG. 3, as would be possible in the known construction, is prevented by engagement of the free ends of the wires 2 with the sheathing 1*b*. It will be appreciated that the construction at the opposite edge of the structure is symmetrical to that of FIG. 3, and angular movement in the direction opposite to that of FIG. 3 is prevented by corresponding engagement of the free ends of wires 2 with the sheathing 1*b* at the opposite edge of the structure. Moreover, since the free end of the hooked wire is embedded in, or at least in contact with the sheathing 1*b*, the hazardous projecting wire end of known construction is eliminated.

Thus it will be seen that the arrangement described above provides a structure having improved rigidity in comparison with the previously known arrangement, and presenting a neater more attractive appearance and eliminating the disadvantages attendant upon the projecting wire ends of the known construction.

It will be understood that various alterations and modifications may be made to the structure as described above, without departing from the scope of the invention. For example, as shown in FIGS. 5 to 7 of the drawings, the transverse wires 2 may be angled as shown, at the point where they are hooked over upon themselves, in order that the centres of the edge wires 1 become located upon the median plane of the element as defined by the axes of the transverse wires 2.

Furthermore, it will be understood that although the cushion supporting element has been described herein in the context of a vehicle seat, the element is not limited to such use, and may be employed in any other context where a support for upholstery material is required, for example in beds, sofas, chairs, etc.

I claim:

1. A cushion support element, comprising two opposed side strands each having an external surface of compressible material, and a plurality of parallel transverse wires of tempered spring wire connected between said side strands, wherein each said spring wire at its point of connection with a respective side strand is wound around said side strand through an angle of less than 360°, is then hooked over upon itself at a point spaced from the surface of the said side strand to provide a terminal portion which extends back into contact with the surface of said side strand to engage the latter at a point spaced from the axis of said transverse wire in a direction parallel to the axis of said side strand, whereby said terminal portion forms a gusset between said transverse wire and the respective side strand to brace them against relative angular movement therebetween, and wherein the configuration of the respective ends of each of the transverse wires is symmetrical whereby angular movement of each of said transverse wires relative to the axis of the side strands is resisted in one direction by the gusset at one end thereof and in the other direction by the gusset at the other end.

2. An element according to claim 1, wherein the said terminal portion at each of said transverse wires is firmly embedded in and deforms said compressible material.

3. An element according to claim 1, wherein the said transverse wires are angled in the region of the points at which they are hooked over upon themselves, so that the axes of the said side strands are substantially coplanar with the axes of the intermediate portions of said transverse wires.

* * * * *